US006829881B1

(12) United States Patent
Manten

(10) Patent No.: US 6,829,881 B1
(45) Date of Patent: Dec. 14, 2004

(54) CUT-RESISTANT ARTICLES OF ARAMID MICROFILAMENTS

(75) Inventor: Johannes Manten, Krefeld (DE)

(73) Assignee: Teijin Twaron GmbH, Wuppertal (DE)

( * ) Notice: Subject to any disclaimer, the term of this patent is extended or adjusted under 35 U.S.C. 154(b) by 0 days.

(21) Appl. No.: 09/762,386

(22) PCT Filed: Jun. 7, 1999

(86) PCT No.: PCT/EP99/04917

§ 371 (c)(1),
(2), (4) Date: Feb. 28, 2001

(87) PCT Pub. No.: WO00/08410

PCT Pub. Date: Feb. 17, 2000

(30) Foreign Application Priority Data

Aug. 7, 1998 (EP) ..... 98202659

(51) Int. Cl.[7] ..... D03G 3/02

(52) U.S. Cl. ..... 57/243; 57/252; 2/2.5; 428/357; 428/359; 428/364; 428/377; 428/395; 428/401

(58) Field of Search ..... 2/1, 455, 456, 2/25, 16, 21, 159, 161.6, 161.7, 907; 428/357, 359, 364–377, 395, 401, 903, 907, 908.8, 911; 442/97, 134, 189, 301, 308, 340, 351, 401, 414; 57/243, 252

(56) References Cited

U.S. PATENT DOCUMENTS

| | | | | |
|---|---|---|---|---|
| 4,738,893 A | | 4/1988 | Grillo | |
| 5,001,003 A | | 3/1991 | Mahr | |
| 5,464,685 A | | 11/1995 | Fry | |
| 5,578,358 A | * | 11/1996 | Foy et al. | 428/104 |
| 5,822,791 A | * | 10/1998 | Baris | 2/2.5 |
| 5,882,791 A | * | 3/1999 | van der Werff et al. | 428/364 |
| 6,001,474 A | * | 12/1999 | Prickett et al. | 428/359 |
| 6,030,683 A | * | 2/2000 | Chitrangad | 428/74 |
| 6,048,486 A | | 4/2000 | Fels et al. | |
| 6,103,371 A | * | 8/2000 | Prickett | 428/359 |
| 6,475,936 B1 | * | 11/2002 | Chiou | 442/203 |

FOREIGN PATENT DOCUMENTS

| | | |
|---|---|---|
| EP | 0 241 681 A2 | 10/1987 |
| EP | 0 609 946 A1 | 8/1994 |
| EP | 0 816 060 A2 | 1/1998 |
| JP | 06-002216 | 1/1994 |
| JP | 7-100039 A | 4/1995 |
| WO | WO 97/21334 | 6/1997 |

* cited by examiner

*Primary Examiner*—Arti R. Singh
(74) *Attorney, Agent, or Firm*—Oliff & Berridge, PLC

(57) ABSTRACT

The invention pertains to cut-resistant articles, in particular to gloves. The articles comprise microfilaments of aromatic polyamides, more preferably p-aramid, wherein the titer of the microfilaments is equal to or smaller than 1.3 dtex ($1.3\times10^{-4}$ g/m). In a preferred embodiment the article is prepared from staple fibers with a length between 38 and 100 mm.

5 Claims, No Drawings

CUT-RESISTANT ARTICLES OF ARAMID MICROFILAMENTS

The invention pertains to cut-resistant articles made of aromatic polyamide microfibers.

It is known that cut-resistant articles can be made of aromatic polyamide (polyaramid) fibers. In DE 29713824 a protective glove has been described the lining of which comprises flexible aramid fiber. In WO 9721334 penetration-resistant compositions have been disclosed in which yarns of aramid fibers are bonded to a polymeric continuum. This material is primarily aimed at body armor for protection against ballistic projectiles, but it is also described that the compositions can be used against sharp objects, such as knives, in gloves, sleeves, shoes, and the like. Gloves made from poly(para-phenylene terephthalate) yarn (p-aramid yarn) are commercially available, for instance, under the name Twaron® Safety Gloves.

Although these articles, in particular gloves, are suitable in many cases, there is still a need for improvement. Such improvement includes a better resistance against stubbing and cutting by sharp objects, such as nails, knives, and the like, but also increase of wear comfort, freedom of movement, and enhanced suppleness are long sought improvements.

It has now been found that cut-resistant articles with improved properties in comparison to known articles can be obtained by using microfibers of aromatic polyamide (polyaramid).

Aromatic polyamide microfibers as such are known, for instance from EP 241,681, wherein articles made of polyaramid microfilaments have been disclosed for use as ballistic protection structures. However, it is unknown for articles made of polyaramid microfilaments to have substantially improved properties with respect to cut resistance and wear comfort.

The present invention therefore pertains to articles made from polyaramid microfibers, and in particular to gloves, sleeves, and cut-protective garments in general. Woven fabrics, knits, or needle felts may be applied. A plurality of layers may be used to improve the performance, and if required, additional layers of a different material, for instance, metallized materials for additional heat protection, may be added.

The aromatic polyamide (polyaramid) may be any aromatic polyamide, such as obtained by the polymerization of an aromatic diamine and an aromatic di-acid chloride. More preferred are para-aromatic polyamides, and most preferred is poly(para-phenylene terephthalate) (PPD-T), which can be obtained from p-phenylenediamine and terephthaloyl chloride.

The aromatic polyamide is spun into microfibers in a manner known in the art and the spun fiber can be used as endless filament yarn, stretch breaking yarn or, more preferably, as spun yarn based on staple fiber. The spun yarns of this invention can be made by any appropriate spinning processes, among which can be mentioned spinning processes, such as cotton, worsted, and woolen ring spinning systems, and open end spinning processes. If staple fibers are used for the manufacture of cut-resistant articles, preferably staple fibers with a length between 38 and 100 mm are used.

The microfibers have a titer of at least 1.3 dtex ($1.3\times10^{-4}$ g/m) or smaller, preferably equal to or less than 1.0 dtex ($10^{-4}$ g/m).

The cut-resistant articles of this invention such as gloves are manufactured, for instance, by knitting the yarn obtained from the aromatic polyamide microfibers.

The yarns according to the present invention are more cut-resistant than comparative standard yarns with titers above 1.3 dtex ($1.3\times10^{-4}$ g/m). If gloves are made of these microfibers, the gloves have superior wear comfort in comparison with gloves with standard filaments. The gloves made with microfibers are much more supple and therefore give the user a high wearing comfort. These gloves therefore are also eminently suitable for performing subtle tasks.

The invention is further illustrated by the following experiments

Knitted samples made out of standard spun yarn and microfilament spun yarn were compared:

The cut resistance was established according to DIN EN 388:

| | standard | micro-fiber | standard | micro-fiber | standard | micro-fiber |
|---|---|---|---|---|---|---|
| fiber titer (dtex) | 1.7 | 0.93 | 1.7 | 0.93 | 1.7 | 0.93 |
| staple fiber titer | Nm 28/2 | Nm 28/2 | 2 × Nm 50/2 | 2 × Nm 80/2 | 2 × Nm 80/2 | 2 × Nm 50/2 |
| plied yarn twist | α 120 | α 120 | α 100 | α 100 | α 100 | α 100 |
| density (horizontal $cm^{-1}$ × vertical $cm^{-1}$) | 7 × 11 | 7 × 11 | 7 × 10 | 7 × 10 | 7 × 9.5 | 7 × 9.5 |
| smallest index | 6.5 | 9.1 | 3.3 | 3.6 | 2.1 | 5.7 |
| performance level | 3 | 3 | 2 | 2 | 1 | 3 |

Conclusion: The smallest index is larger for the microfiber yarn than for the standard yarn. The performance was always better for the microfiber yarn. Where the performance has the same number according to DIN EN 388, the standard sample is at the lower end and the microfiber sample at the higher end of the performance level.

Moreover, the knitted fabrics based on microfibers are much softer and have a finer "hand" than comparable fabrics based on standard fibers with a count of 1.7 dtex.

In addition, the mechanical properties of spun yarns based on microfiber and standard fibers have been investigated. These spun yarns were produced according to the cotton ring spinning process. As can be seen from the tables below, the strength is considerably improved for the microfiber spun yarns. We believe that the higher tensile strength of the microfiber spun yarns is responsible for the improved cut resistance of fabrics made from microfibers. The flexibility was determined according to DIN 53362. The flexibility, denoted as the bending stiffness, is a measure for the "grip" and the suppleness of the gloves.

| | standard | microfiber | standard | microfiber |
|---|---|---|---|---|
| fiber titer (dtex) | 1.7 | 0.93 | 1.7 | 0.93 |
| staple fiber titer | Nm 50/2 | Nm 50/2 | Nm 50/2 | Nm 50/2 |
| yarn twist | α 100 | α 100 | α 120 | α 120 |
| strength (N) | 39.47 | 43.55 | 39.72 | 42.97 |
| bending stiffness ($cN/cm^2$) | 56.89 | 9.90 | 17.60 | 13.60 |
| fiber titer (dtex) | 1.7 | 0.93 | 1.7 | 0.93 |
| staple fiber titer | Nm 80/2 | Nm 80/2 | Nm 80/2 | Nm 80/2 |
| yarn twist | α 100 | α 100 | α 120 | α 120 |
| strength (N) | 20.96 | 21.52 | 19.99 | 21.03 |
| bending stiffness ($cN/cm^2$) | 12.47 | 5.52 | 12.94 | 4.37 |

Conclusion: the strength is considerably improved for microfiber staple fibers, whereas in all cases improved bending stiffness was found for gloves made from microfibers.

What is claimed is:

1. A cut-resistant article comprising aromatic polyamide microfibers wherein the titer of the microfibers is equal to or smaller than 1.3 dtex (1.3*10 4 g/m) and the microfibers are in a form of stretch breaking yarns or spun yarn based on a staple fiber.

2. The cut-resistant article of claim 1 comprising para-aramid microfibers.

3. The cut-resistant article of claim 2 comprising poly para-phenylene terephthalate) microfibers.

4. The cut-resistant article of claim 1 wherein the microfibers are in the form of staple fibers with a length between 38 and 100 mm.

5. The cut-resistant article of claim 1 wherein the article is a glove.

* * * * *

UNITED STATES PATENT AND TRADEMARK OFFICE

CERTIFICATE OF CORRECTION

PATENT NO. : 6,829,881 B1
DATED : January 6, 2005
INVENTOR(S) : Johannes Manten

It is certified that error appears in the above-identified patent and that said Letters Patent is hereby corrected as shown below:

Title page,
Item [22], PCT Filed, please change "Jun. 7, 1999" to -- July 6, 1999 --.

Column 2,
Line 11, please change "microfilament" to -- microfiber --.

Signed and Sealed this

Fourteenth Day of June, 2005

JON W. DUDAS
*Director of the United States Patent and Trademark Office*